United States Patent [19]

Benzon-Petersen

[11] 3,974,957

[45] Aug. 17, 1976

[54] PACKAGES

[75] Inventor: Boye Ditlef Benzon-Petersen, Lund, Sweden

[73] Assignee: AB Akerlund & Rausing, Lund, Sweden

[22] Filed: May 30, 1975

[21] Appl. No.: 582,177

[30] Foreign Application Priority Data

June 5, 1974 Sweden ..... 7407413

[52] U.S. Cl. ..... 229/55; 229/66; 206/466

[51] Int. Cl.[2] ..... B65D 33/00; B65D 33/02; B65D 73/00

[58] Field of Search ..... 206/461, 466; 229/53, 229/55, 66; 105/3, 5

[56] References Cited

UNITED STATES PATENTS

| | | | |
|---|---|---|---|
| 2,296,272 | 9/1942 | DeSherbinin | 206/461 |
| 3,026,016 | 3/1962 | Scher | 229/55 |
| 3,360,183 | 12/1967 | Stahl | 229/55 |

*Primary Examiner*—William Price
*Assistant Examiner*—Douglas B. Farrow
*Attorney, Agent, or Firm*—Pierce, Scheffler & Parker

[57] ABSTRACT

The package of the invention is of the type having a relatively rigid back and flexible front part the two being united along a sealing line which is interrupted for a portion of the distance to provide an opening. In the package of the invention the opening is covered by a sheet attached to the flexible front portion of the package below the opening, and has a slot cooperating with the opening.

8 Claims, 5 Drawing Figures

PACKAGES

The present invention relates to a package consisting of a relatively rigid sheet-like back and a flexible, preferably entirely transparent front which is united to the back along a sealing line forming a packaging space, said sealing line being interrupted along a distance forming an opening for the packaging space.

Packages according to the invention are characterized by the feature that the said opening to the packaging space is covered by a sheet cover which is attached to the flexible front below the opening and which has a slot essentially coinciding with the opening, compression of the package in the lateral sense being adapted to open the slot and consequently the opening to the packaging space.

The package according to the invention is chiefly intended for use in connection with the portioning of tablet medicines in hospitals and similar institutions. The following description will show, however, that the invention may also be used for many other purposes, e.g. for packaging in general.

In an essentially rectangular package the slot and consequently the opening to the packaging space are preferably made parallel with the top and bottom margins.

In order to facilitate compression of the package in the lateral sense both the sheet-like back and the sheet cover may be provided with crease lines extending transversely of the slot and the opening to the packaging space.

A very simple manufacture by means of conventional machines can be achieved by letting the sheet cover be formed by a top portion of the back, which is bent downward and attached to the flexible front. In such a construction it becomes possible, by applying a unilateral pressure to the back of the spread carton blank, to provide a pressure from two sides on the finished package, which is an essential advantage in the manufacture.

A simple sealing of the package can be achieved by providing the back with an arcuate slot forming a tongue or flap which can be introduced through the slot in the sheet cover, thus sealing the package after it has been filled.

Preferably, the front and back are united with each other along three of the lateral margins. Alternatively, however, it is possible to let the packaging space be delimited by a U-shaped or V-shaped seal.

In order to facilitate the opening of a filled and sealed package the slot in the cover plate may be extended on both sides by perforations. Also the back is in such a case provided with a perforation opposite the slot. As a result of this the whole packaging space above the slot may easily be removed by being torn off, if desired.

The invention will be described in greater detail in the following with reference to the accompanying drawings describing in the first place a preferred embodiment of the subject matter of the invention but also indicating certain alternatives.

Figure 5:
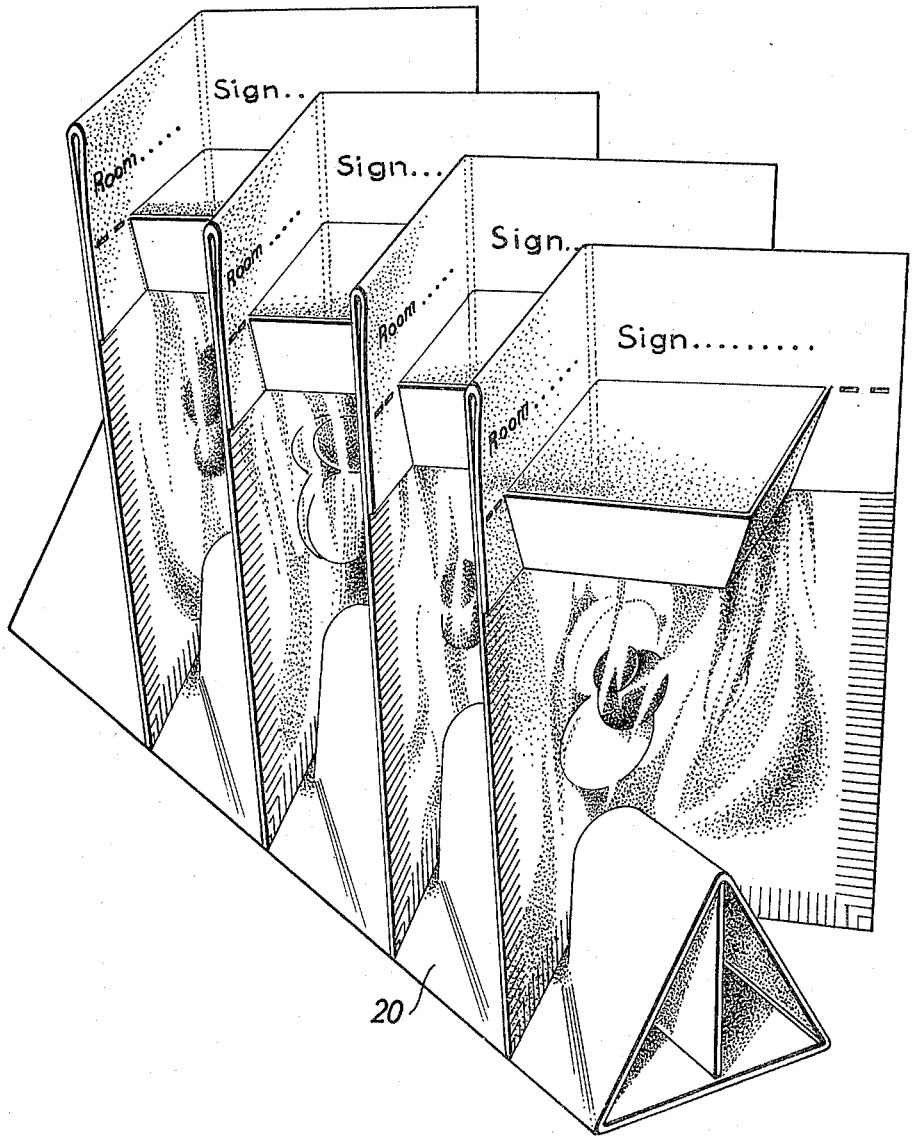

FIG. 5, finally, shows four packages according to the invention placed in a simple rack.

Figure 1:
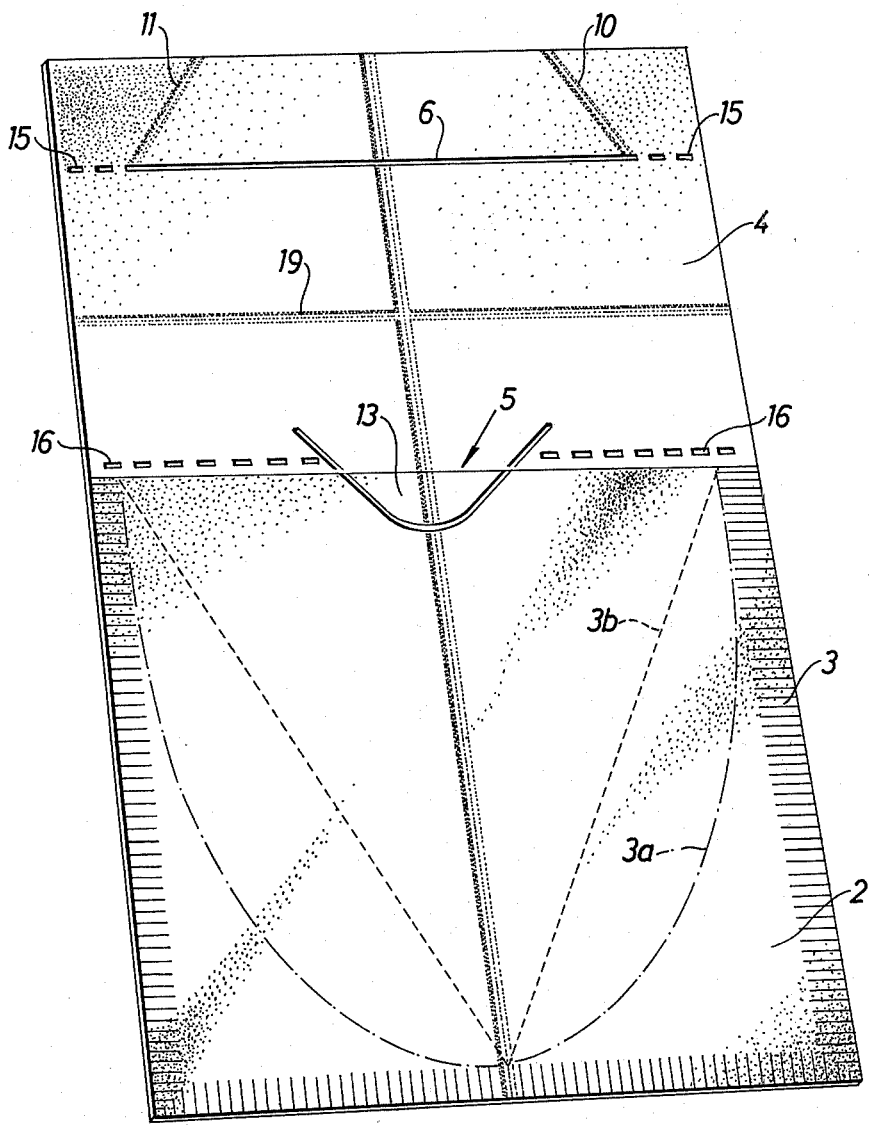
FIG. 1 shows a package according to the invention before part of its back has been folded down over the front in order to form the sheet cover mentioned above.

Thus, FIG. 1 shows the package according to the invention before it is completely finished. It is in that case composed of a relatively rigid sheet-like back 1 of for instance cardboard and a flexible, preferably entirely transparent front 2 of for instance a plastic material, such as polyethylene or the like. The front and back are united with each other by glue or a heat seal 3 shown in parallel dashed lines. The lines **3*a* and 3*b* indicate, however, that the said seal may be exchanged against a U-shaped and a V-shaped seal, respectively. The latter seal 3*a* and 3*b*** may also have the shape of a line but these seals are preferably allowed to fill the whole space between the shown lines and the outer marginal lines of the package.

Figure 2:
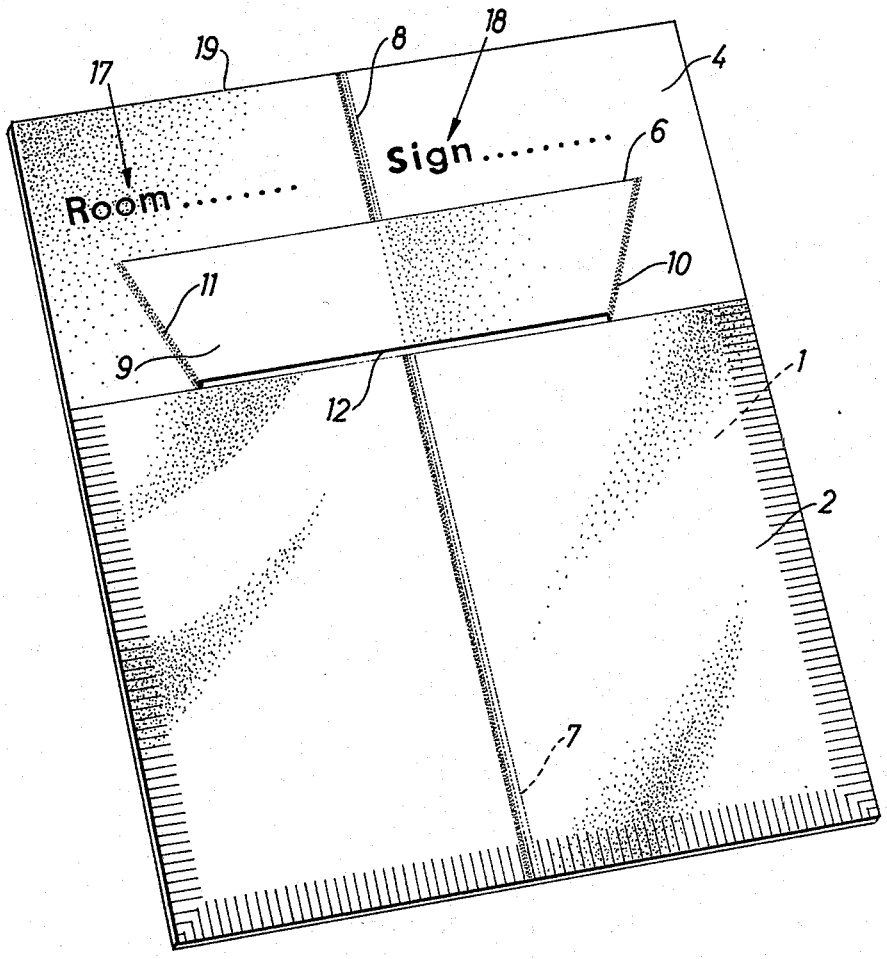
FIG. 2 shows the same package after the said portion has been folded down.
Figure 3:
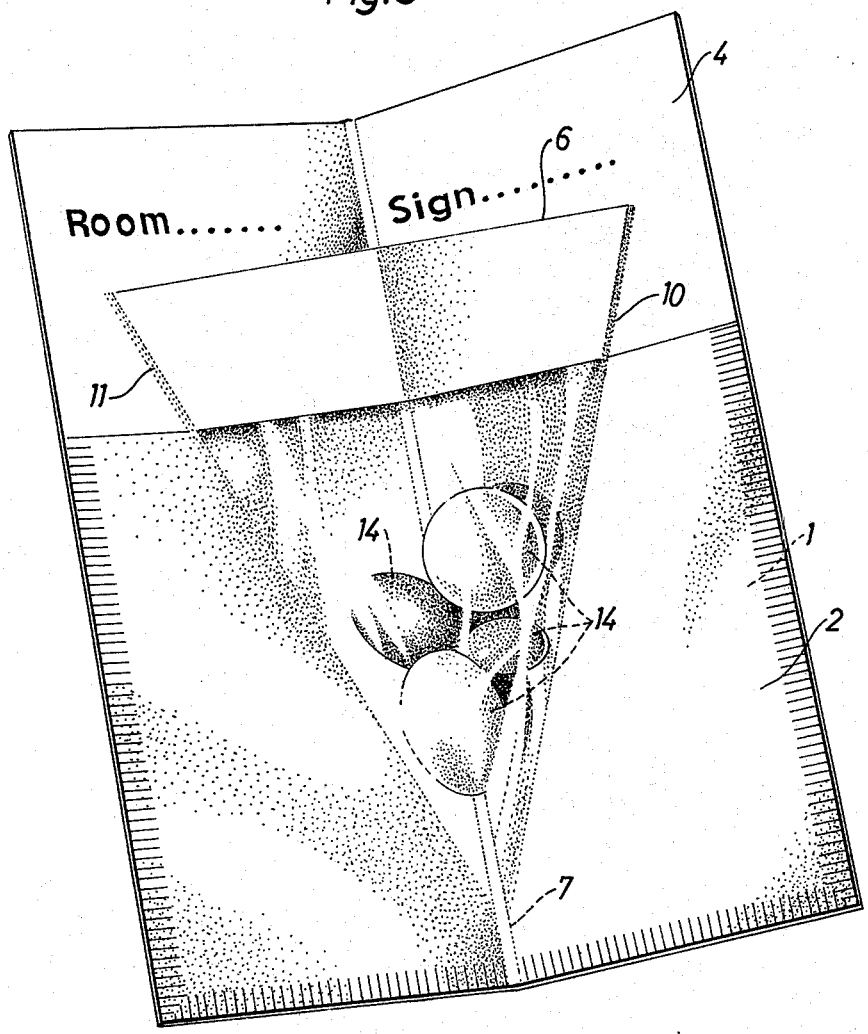
FIG. 3 shows the package open and filled with some tablets.

The back 1 is provided with a top extension 4 which, as shown in FIG. 2, is meant to be folded down over the front and be attached thereto below the package opening 5. The extension 4 of the back will then form the above sheet cover and will therefore be called sheet cover hereinafter. Opposite the package opening 5 the sheet cover 4 is provided with a slot 6. Transversely of that slot, and consequently also transversely of the package opening, both the back 1 and the cover sheet 4 are provided with centrally extending crease lines 7 and 8, respectively. These crease lines facilitate compression of the package in the lateral sense. At such compression in the lateral sense the portion 9 of the sheet cover is pressed forward. The said portion 9 is delimited in the lateral sense by two crease lines 10 and 11 and in the vertical sense by the slots 6 and the free end margin 12, respectively.

Figure 4:
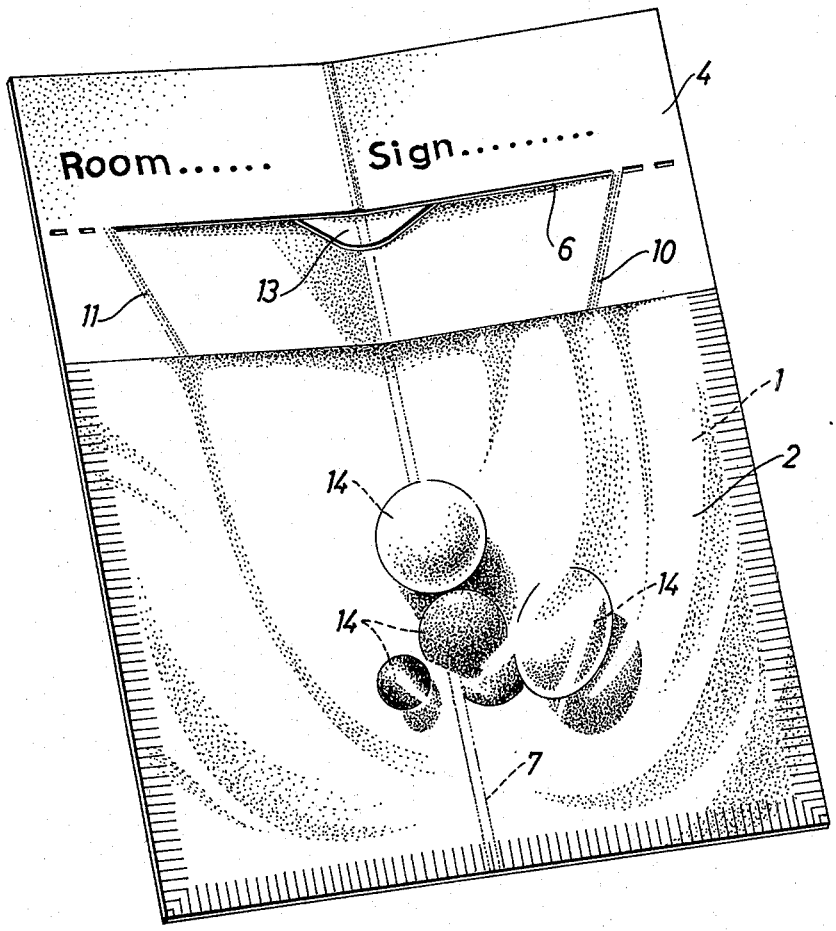
FIG. 4 shows the package sealed again.

As is best shown in FIGS. 1 and 4, the back 1 is provided with a flap 13 which may be pressed through the slot 6 in order to seal the package after it has been filled with tablets 14. The size of the flap 13 is a matter of judgement. If it is made too small, the package may be opened by mistake. If it is instead made too large, it may be difficult for the patient to open the package. The opening operation is however facilitated if the slot 6 is provided in the lateral sense with extensions in the nature of perforations 16 and if the back is simultaneously provided with corresponding perforations 16 opposite to the perforations 15. In that embodiment the whole portion of the package above the slot 6 may as a matter of fact easily be removed by tearing.

By 17 and 18 it is indicated that the sheet cover 4 may be provided with a printed text. The same applies of course to the whole back, which has not been shown. This may for instance be stamped with the text of the patient's card containing all essential information on the patient, such as name, address, birth date, etc.

Reference numeral 19 designates a crease line dividing the used carton material into the back 1 proper and the cover portion 4. Alternatively, it is of course possible to use a separate sheet 4 which like the back 1 and the front 2 may be fed to a packaging machine in the nature of strip shaped materials and be united there. This whole operation will of course be facilitated if both the material for the back and for the sheet cover consist of plastic coated carton material which may be heat sealed like the front material.

In FIG. 5, finally, there are shown four packages according to the invention placed in a simple rack 20 for cartons. This figure is meant to illustrate how a nurse can place four packages for a patient meant for medicine doses in the morning, at noon, in the afternoon and in the evening, and fill them at the same time. If desirable, the packages may be provided with a corresponding marking or they may be made from materials in different colours, for instance yellow for the morning dose, blue for the noon dose, etc.

The invention is not limited to the embodiment described but may be varied within the scope of the following claims. Thus, the materials as well as embodiment details may be varied within wide limits.

I claim:

1. A package consisting of a relatively rigid sheet-like back (1) and a flexible, preferably entirely transparent front (2) which is united with the back along a seal line (3, 3*a*, 3*b*), forming a packaging space, said seal line being interrupted along a distance forming an opening (5) for a packaging space, characterized in that the said opening (5) to the packaging space is covered by a sheet cover (4) which is attached to the flexible front (2) below the opening (5) and which is provided with a slot (6) essentially coinciding with the opening, compression of the package in the lateral sense being adapted to open the slot (6) and consequently the opening (5) to the packaging space.

2. A package as claimed in claim 1, characterized in that in an essentially rectangular package the slot (6) and consequently also the opening (5) to the packaging space are provided in parallel with the top and bottom margins.

3. A package as claimed in claim 2, characterized in that both the sheet-like back (1) and the sheet cover (4) are provided with crease lines (7 and 8), respectively, extending transversely of the slot (6) and the opening (5) to the packaging space in order to facilitate compression of the package in the lateral sense.

4. A package as claimed in claim 1, characterized in that the sheet cover (4) is formed by an upper portion of the back (1) which has been folded down over and attached to the flexible front (2).

5. A package as claimed in claim 1, characterized in that the back (1) is provided with an arcuate slot forming a flap (13) which may be pressed through the slot (6) in the sheet cover (4), thereby causing sealing of the package after it has been filled.

6. A package as claimed in claim 1, characterized in that the front (2) is united with the back (1) along a U-shaped or V-shaped seal (3*a* and 3*b*, respectively).

7. A package as claimed in claim 1, characterized in that the slot (6) is extended on both sides by perforations (15) and that also the back (1) is provided with a perforation (16) opposite the slot (6), whereby the packaging portion above said slot may easily be removed.

8. A package as claimed in claim 1, characterized in that the portion (9) of the cover sheet which is attached to the flexible front (2) below the opening (5) is interrupted by two crease lines (10 and 11) starting from the ends of the slot (6) of the sheet cover and reading its free lower edge (12), said crease lines (10, 11) preferably converging towards a point on the central line of the package.

* * * * *